US006129206A

United States Patent [19]

Cooper

[11] Patent Number: 6,129,206

[45] **Date of Patent: *Oct. 10, 2000**

[54] FASTENER CLIP

[75] Inventor: William J. Cooper, Woonsocket, R.I.

[73] Assignee: Avery Dennison Corporation, Pasadena, Calif.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/116,008

[22] Filed: Jul. 15, 1998

[51] Int. Cl.[7] ..... B65D 85/24

[52] U.S. Cl. ..... 206/343; 206/820

[58] Field of Search ..... 206/343, 345, 206/335, 348, 820

[56] References Cited

U.S. PATENT DOCUMENTS

| | | | |
|---|---|---|---|
| Re. 32,332 | 1/1987 | Kato . | |
| Re. 34,891 | 4/1995 | Kunreuther . | |
| 3,733,657 | 5/1973 | Lankton . | |
| 3,850,297 | 11/1974 | Merser . | |
| 4,456,123 | 6/1984 | Russell . | |
| 4,534,464 | 8/1985 | Lankton . | |
| 4,586,609 | 5/1986 | Won . | |
| 4,654,935 | 4/1987 | Bone . | |
| 4,660,718 | 4/1987 | Kato et al. | 206/820 |
| 4,712,677 | 12/1987 | Russell | 206/345 |
| 4,901,854 | 2/1990 | Bone et al. | 206/343 |
| 5,518,162 | 5/1996 | Deschenes et al. . | |

*Primary Examiner*—David T. Fidei
*Assistant Examiner*—Nhan T. Lam
*Attorney, Agent, or Firm*—Kriegsman & Kriegsman

[57] ABSTRACT

A unitary, plastic clip of fasteners comprises a plurality of individual fasteners which are disposed in a substantially parallel, stacked, spaced relationship. Each fastener comprises an elongated flexible filament and a pair of transverse cross-bars which are disposed on opposite ends of the filament, the pair of transverse bars being disposed in perpendicular relation to the filament. The plurality of individual fasteners are maintained in its substantially parallel, stacked, spaced configuration by a plurality of thin, severable connector posts. One thin, severable connector post interconnects the approximate midpoint of the transverse bars of each pair of adjacent individual fasteners.

6 Claims, 3 Drawing Sheets

11

11

FASTENER CLIP

BACKGROUND OF THE INVENTION

The present invention relates generally to plastic fasteners and more particularly to clips of plastic fasteners.

Plastic fasteners are well known in the art and are commonly used to couple together a pair of objects. For example, plastic fasteners are commonly used to couple or recouple a button onto an article of clothing.

Plastic fasteners typically comprise a flexible filament which has an enlarged head formed at one end and a transverse bar, or T-bar, formed at the opposite end.

A plurality of such plastic fasteners are typically manufactured as part of a unitary fastener clip, also commonly referred to as a fastener assembly, in which the individual fasteners are interconnected in a row to a stringer or runner bar. In one well-known type of fastener clip, the transverse bar of each individual fastener is connected to the runner bar by a thin, severable connector post, or neck.

In U.S. Pat. No. Re. 34,891 to S. J. Kunreuther there is disclosed an assembly of attachments and a device for attaching the same. The assembly includes first and second parallel connecting bars between which individual attachments are situated in parallel, spaced relation. Each of the attachments includes first and second T-bar ends with a flexible filament extending therebetween. The attaching device includes a housing with a recess having first and second sections adapted to receive the first and second connecting bars, respectively. First and second hollow needles extend from the housing. The T-bar ends are pushed through needles by simultaneously actuatable ejector rods after each is severed from the associated connecting bar. The assembly of the attachments is advanced through the housing to align the T-bars with the needles by simultaneously actuated indexing gears. The gears cooperate with the elements which join the T-bar ends and the connecting bars.

It should be noted that fastener assemblies which comprise a runner bar experience notable drawbacks. Specifically, fastener assemblies which employ runner bars often limit the number of fasteners which can be conveniently supplied in a single assembly. Furthermore, fastener assemblies which employ runner bars waste material since the runner bar is not put to productive end use.

Plastic fasteners of the type described above are commonly designed to be inserted through hollow slotted needles for tagging or for joining two objects together. Such fasteners, together with the apparatus for applying them, have been widely employed for the attachment of buttons to garments, for the pairing of items such as shoes, and in various industrial applications.

In U.S. Pat. No. 5,518,162, there is disclosed a fastener attaching tool which is well-known and widely used in commerce. The fastener attaching tool is particularly suited for use in attaching buttons to clothing, etc. and is constructed for use with a fastener clip which includes a pair of runner bars and one or more U-shaped fasteners having transverse bars at opposite ends, each transverse bar being connected on its side to a corresponding runner bar by a severable connector post. The tool includes a body having a front end. A pair of needles are pivotally mounted at the front end of the body, each needle having a longitudinal slotted bore adapted to receive one of the transverse bars and a knife edge formed on one side which is adapted to sever a connector post from its associated transverse bar as the transverse bar is pushed through the needle. The body is shaped to include a transverse feed slot down through which the fastener clip is manually inserted. The tool also includes an ejector mechanism which is slidably mounted back and forth within the body and is rearwardly biased by a spring. The ejector mechanism is moved manually forward from the rear of the tool and includes a pair of ejector rods which are used to push the transverse bars into and through the bores in the needles. The body includes a pair of flexible fingers which cooperate with a pair of posts on the ejector mechanism to prevent automatic return of the ejector mechanism from its forwardmost position in the body to its rearwardmost position when forward pressure on the ejector mechanism is removed.

SUMMARY OF THE INVENTION

It is an object of this invention to provide a new and improved fastener clip.

It is another object of this invention to provide a cable tie as described above which has a minimum number of parts, is simple in construction and is easy to use.

Accordingly, there is provided a clip of fasteners comprising a plurality of individual fasteners disposed in a substantially parallel, spaced relationship, each fastener comprising an elongated flexible filament and a pair of transverse cross-bars disposed on opposite ends of said filament, and a plurality of thin, severable connector posts for maintaining said plurality of individual fasteners disposed in a substantially parallel, spaced relationship, said plurality of thin, severable connector posts interconnecting said plurality of fasteners to one another.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
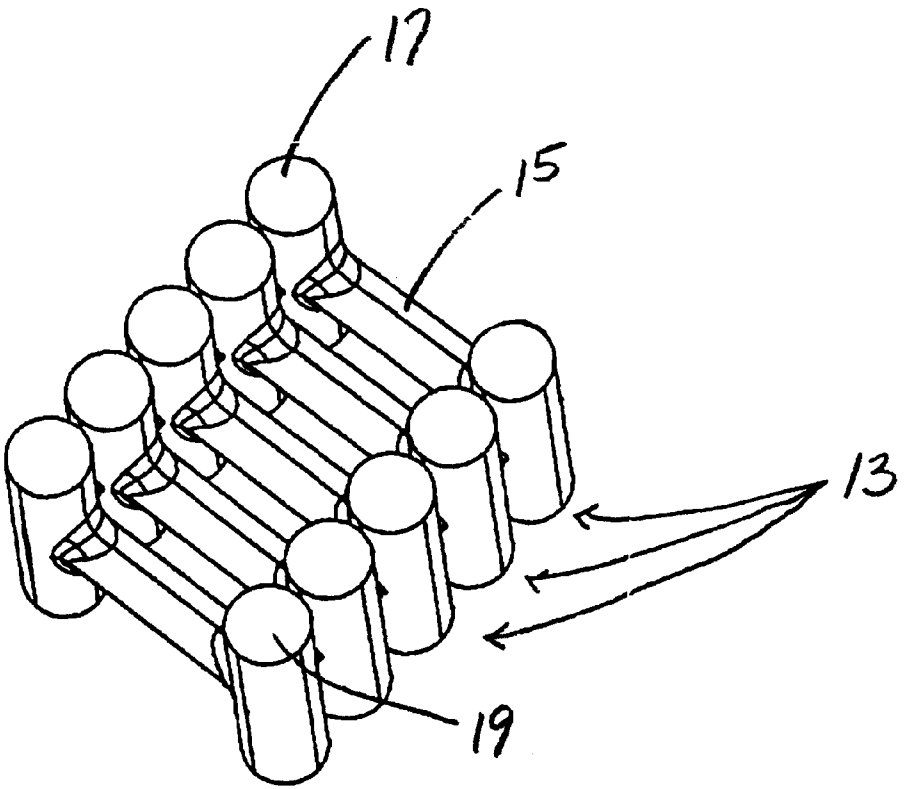
FIG. 1 is a top perspective view of a clip of fasteners constructed according to the teachings of the present invention.

Referring now to the drawings, there is shown a fastener clip constructed according to the teachings of the present invention, the fastener clip being identified by reference numeral 11. Fastener clip 11 is designed to be used to couple or recouple buttons to garments or fabrics; however, it is to be understood that the invention is not exclusively limited to the coupling or recoupling of buttons onto garments or fabrics, but rather may be used to join various objects together.

Fastener clip 11 is designed to be used with a fastener attaching tool to couple buttons to articles of clothing. For example, fastener clip 11 is designed to be used with a fastener attaching tool of the type disclosed in U.S. Pat. No. 5,518,162 to C. L. Deschenes et al, which is incorporated herein by reference.

Fastener clip 11 is a unitary structure preferably molded from a plastic such as polyurethane. Fastener clip 11 is shown comprising five identical fasteners 13; however, it is to be understood that the number of fasteners 13 in fastener clip 11 is illustrative only and could be increased or decreased without departing from the spirit of the present invention.

Each fastener 13 comprises a thin, elongated, flexible filament 15 and a pair of transverse bars, or feet, 17 and 19 disposed at opposite ends thereof. Transverse bars 17 and 19 are disposed in perpendicular relation to flexible filament 15 so that each fastener 13 has a generally H-shaped configuration.

Filament 15 and transverse bars 17 and 19 of fasteners 13 are shown as having a cross-section which is generally circular in shape; however, it is to be understood that filament 15 and transverse bars 17 and 19 could have alternatively-shaped cross-sections, such as ovaloid or rectangular, without departing from the spirit of the present invention.

Figure 2:
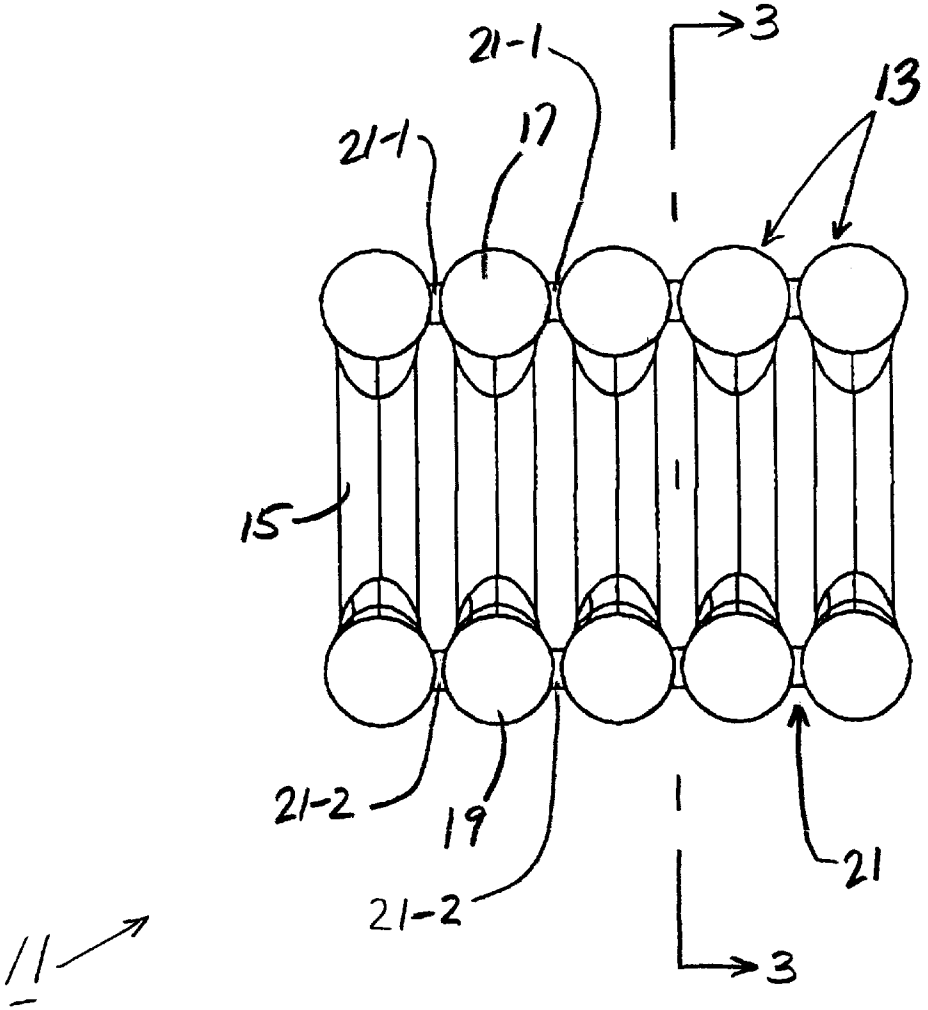
FIG. 2 is a top view of the clip of fasteners shown in FIG. 1.
Figure 3:
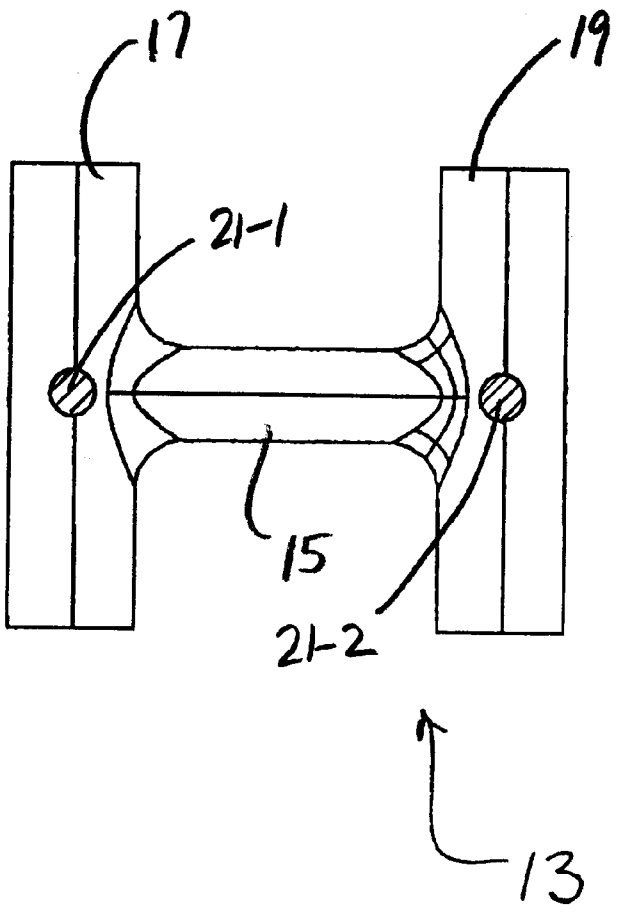
FIG. 3 is a front view of the clip of fasteners shown in FIG. 2, taken along lines 3—3.

Fasteners 13 are disposed in a substantially parallel, spaced relationship and are interconnected by a plurality of thin, short, severable connector posts 21 to make fastener clip 11 a unitary structure. As shown in FIG. 2, a first set of connector posts 21-1 interconnects adjacent fasteners 13 at the approximate midpoint of adjacent transverse bars 17. Similarly, a second set of connector posts 21-2 interconnects adjacent fasteners 13 at the approximate midpoint of adjacent transverse bars 19.

As can be appreciated, connector posts 21 have a power of connection which is great enough to maintain fasteners 13 in a joined-together, substantially parallel, spaced relationship. At the same time, connector posts 21 have a power of connection which is small enough to allow the connector posts 21 to be severed when each fastener 13 is driven by an attachment device through an item of merchandise and when a shearing force is then acted upon connector post 21 through the operation of the attachment device.

Connector posts 21 are shown as having a cross-section which is generally circular in shape; however, it is to be understood that connector posts 21 could have an alternatively-shaped cross-section, such as an ovaloid or rectangular cross-section, without departing from the spirit of the present invention.

It should be noted that connector posts 21 enable fasteners 13 to be connected to form unitary fastener clip 11 without the need for a common runner bar. As can be appreciated, the elimination of a common runner bar eliminates the amount of waste material for fastener clip 11, thereby decreasing the total manufacturing cost for fastener clip 11, which is highly desirable.

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A runner bar-less clip of fasteners comprising:

(a) a first fastener, said first fastener comprising a flexible filament having a first transverse bar at a first end thereof and a second transverse bar at a second end thereof, said first transverse bar of said first fastener having a length and an approximate midpoint thereto, (b) a second fastener, said second fastener comprising a flexible filament having a first transverse bar at a first end thereof and a second transverse bar at a second end thereof, said first transverse bar of said second fastener having a length and an approximate midpoint thereto, (c) said first fastener and said second fastener being disposed in a substantially parallel, spaced relationship, and (d) a first connector post interconnecting the first transverse bar of said first fastener and the first transverse bar of said second fastener at only the approximate midpoints thereof.

2. The runner bar-less clip of fasteners as claimed in claim 1 wherein said first connector post has a length perpendicular to said length of said first transverse bar and perpendicular to said length of said second transverse bar.

3. The runner bar-less clip of fasteners as claimed in claim 2 wherein said first connector post is circular in cross-section.

4. A clip of fasteners comprising:

(a) a first fastener said first fastener comprising a flexible filament having a first transverse bar disposed at a first end thereof and a second transverse bar disposed at a second end thereof;

(b) a second fastener, said second fastener comprising a flexible filament having a first transverse bar disposed at a first end thereof and a second transverse bar disposed at a second end thereof;

(c) said first fastener and said second fastener being arranged in a substantially parallel, spaced relationship;

(d) a first connector post interconnecting the first transverse bar of said first fastener and the first transverse bar of said second fastener; and (e) a second connector post interconnecting the second transverse bar of said first fastener and the second transverse bar of said second fastener;

(f) wherein each of said first transverse bar of said first fastener, said second transverse bar of said first fastener, said first transverse bar of said second fastener and said second transverse bar of said second fastener has a length and an approximate midpoint thereto and wherein said first connector post interconnects the first transverse bar of said first fastener and the first transverse bar of said second fastener only at the approximate midpoints thereof and wherein said second connector post interconnects the second transverse bar of said first fastener and the second transverse bar of said second fastener only at the approximate midpoints thereof.

5. The clip of fasteners as claimed in claim 4 wherein said first connector post has a length perpendicular to said lengths of said first and second transverse bars and wherein said second connector post has a length perpendicular to said lengths of said first and second transverse bars.

6. The clip of fasteners as claimed in claim 5 wherein said first and second fasteners are interconnected only by said first and second connector posts.

* * * * *